US008479657B2

(12) United States Patent
Switzeny

(10) Patent No.: US 8,479,657 B2
(45) Date of Patent: Jul. 9, 2013

(54) CABLE RAILWAY WITH ENTERING/EXITING AID

(75) Inventor: Kurt Switzeny, Brunnen (CH)

(73) Assignee: Innova Patent GmbH, Wolfurt (AT)

( * ) Notice: Subject to any disclaimer, the term of this patent is extended or adjusted under 35 U.S.C. 154(b) by 280 days.

(21) Appl. No.: 12/810,881

(22) PCT Filed: Dec. 2, 2008

(86) PCT No.: PCT/CH2008/000504
§ 371 (c)(1),
(2), (4) Date: Jun. 28, 2010

(87) PCT Pub. No.: WO2009/082827
PCT Pub. Date: Jul. 9, 2009

(65) Prior Publication Data

US 2010/0282121 A1 Nov. 11, 2010

(30) Foreign Application Priority Data

Dec. 28, 2007 (CH) ..... 2025/07

(51) Int. Cl.
*B61K 1/00* (2006.01)
*A63G 1/00* (2006.01)

(52) U.S. Cl.
USPC ..... 104/20; 104/53

(58) Field of Classification Search
USPC ..... 104/18–21, 27–31; 198/321, 324, 198/325, 334
See application file for complete search history.

(56) References Cited

U.S. PATENT DOCUMENTS

| | | | | | |
|---|---|---|---|---|---|
| 3,485,182 | A | * | 12/1969 | Murphy et al. | 104/25 |
| 3,735,851 | A | * | 5/1973 | Patin | 198/334 |
| 3,811,385 | A | | 5/1974 | Johnson et al. | |
| 3,865,041 | A | * | 2/1975 | Bacon | 104/20 |
| 4,543,886 | A | * | 10/1985 | Spieldiener et al. | 104/53 |
| 5,626,078 | A | | 5/1997 | Fuchs | |

FOREIGN PATENT DOCUMENTS

| | | | |
|---|---|---|---|
| DE | 1605810 | A1 | 4/1971 |
| EP | 0430091 | A1 | 6/1991 |
| EP | 0736434 | A2 | 10/1996 |

* cited by examiner

*Primary Examiner* — R. J. McCarry, Jr.
(74) *Attorney, Agent, or Firm* — Laurence A. Greenberg; Werner H. Stemer; Ralph E. Locher

(57) ABSTRACT

In order to facilitate entering or exiting in a cable railway system, at least one part of the floor of the passenger region adjoining the passenger gondolas is formed by a transport device, which is configured to transport the passengers located thereon in the direction of movement of the passenger gondolas. The transport device can be formed by one or more conveyor belts, which follow the path of the passenger gondolas for a distance such that the passenger can comfortably change over from the transport device to the gondolas.

16 Claims, 5 Drawing Sheets

CABLE RAILWAY WITH ENTERING/EXITING AID

REFERENCE TO RELATED APPLICATIONS

This application claims the priority of Swiss patent application 2025/07 which was filed on 28 Dec. 2007 and the complete disclosure of which is hereby incorporated by reference.

BACKGROUND

The invention relates to a cable railway comprising passenger gondolas and a passenger region in which passengers can enter and/or exit the passenger gondolas.

In a cable railway installation comprising continuously revolving gondolas, the passengers in the stations have to board or alight in the passenger region while the gondolas are moving onward. In the previously known cable railways designed in this way, the passengers go to the sideways moving gondolas and have at the same time also to hang up their sports equipment in the mounts attached for this purpose to the outside of the gondolas. For many passengers, this is a new and unfamiliar situation which can be coordinated only with difficulty, as a plurality of activities have to proceed at the same time. If unpredictable complications are also added to the overall sequence, such as for example the fact that the skis do not immediately fit into the mount, panic reactions can occur. As the gondolas move onward with the gondola doors pivoted outward, this then often results in collisions and in hazardous situations requiring the station staff to intervene. In high-power paths, this then results in power losses of the installation or even in accidents. However, similar situations can also occur when alighting from the gondola.

SUMMARY OF THE INVENTION

This gives rise to the object of simplifying boarding or disembarking in installations of this type.

This object is achieved by the cable railway as claimed. According to this, at least a part of the bottom of the passenger region adjoining the passenger gondolas is formed by a conveying means which is configured to convey the passengers located thereon in the direction of movement of the passenger gondolas.

As the gondola is boarded in synchronization or at an at least relatively low difference in speed between the conveying means and the gondola, the above-mentioned hazardous situations are prevented or at least defused, as a plurality of the activities of the passengers do not have to be carried out at the same time. The passengers can hang up the sports equipment without at the same time having to worry about adapting to the high gondola speed. The boarding can then likewise take place in such a way that there is hardly any or no difference in speed from the gondola.

Preferably, the conveying means is configured as a conveying belt, although it can for example also be configured as a platform rotating about the center point of the looping arc of the passenger gondolas.

BRIEF DESCRIPTION OF THE DRAWINGS

Further configurations, advantages and applications of the invention will emerge from the dependent claims and from the following description with reference to the figures, in which:

WAYS OF CARRYING OUT THE INVENTION

Figure 1:
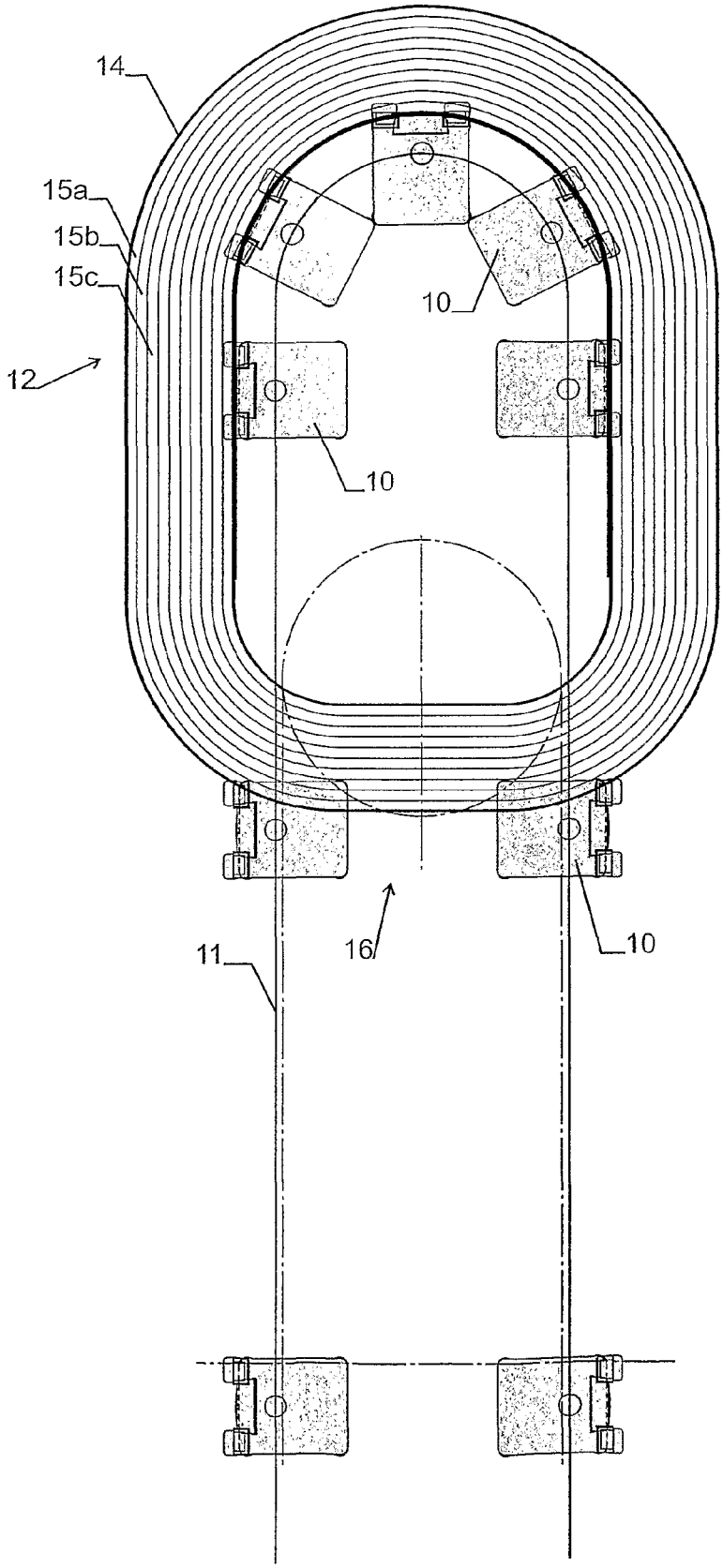
FIG. 1 is a plan view of a first embodiment of the invention.

FIG. 1 illustrates an exemplary embodiment of the invention in the region of a station. The cable railway has a large number of passenger gondolas 10 which are guided and driven in a known manner on cables 11 and are deflected in the region of the station on a looping arc through for example 180°. The passenger gondolas 10 are normally moved continuously and are permanently in motion even in the station.

A passenger region 12, in which the passengers board and/or alight, is provided in the station adjoining the passenger gondolas 10. In order to make this easier for the passengers, at least a part of the floor of the passenger region 12 is formed by a conveying means 14 which serves to move the passengers located thereon in the direction of movement of the passenger gondolas 10.

In a preferred exemplary embodiment, the conveying means is formed by one or more conveying belts. A plurality of conveying belts 15*a*, 15*b*, 15*c*, . . . , which run next to one another at different speeds and in this way form a plurality of conveying regions moving at different speeds, are provided in the embodiment according to FIG. 1. That conveying region or that conveying belt which is located on the next region or belt adjoining the passenger gondolas 10 runs roughly at the same speed as the passenger gondolas 10, while the conveying belts or conveying regions positioned further outward run increasingly slowly. The belts therefore run most slowly in the region for boarding the outer side of the arc. This makes it easier for the passengers to enter the passenger region 12.

Each of the conveying belts 15*a*, 15*b*, 15*c*, . . . is formed by a continuous belt running on a closed path. The belts are guided on an exit-side region 16 of the station from one side to the other and then run back along and parallel to the path of the passenger gondolas 10. In this case, it must be ensured that the belts do not obstruct the passenger gondolas 10. There are various possibilities for this.

Figure 2:
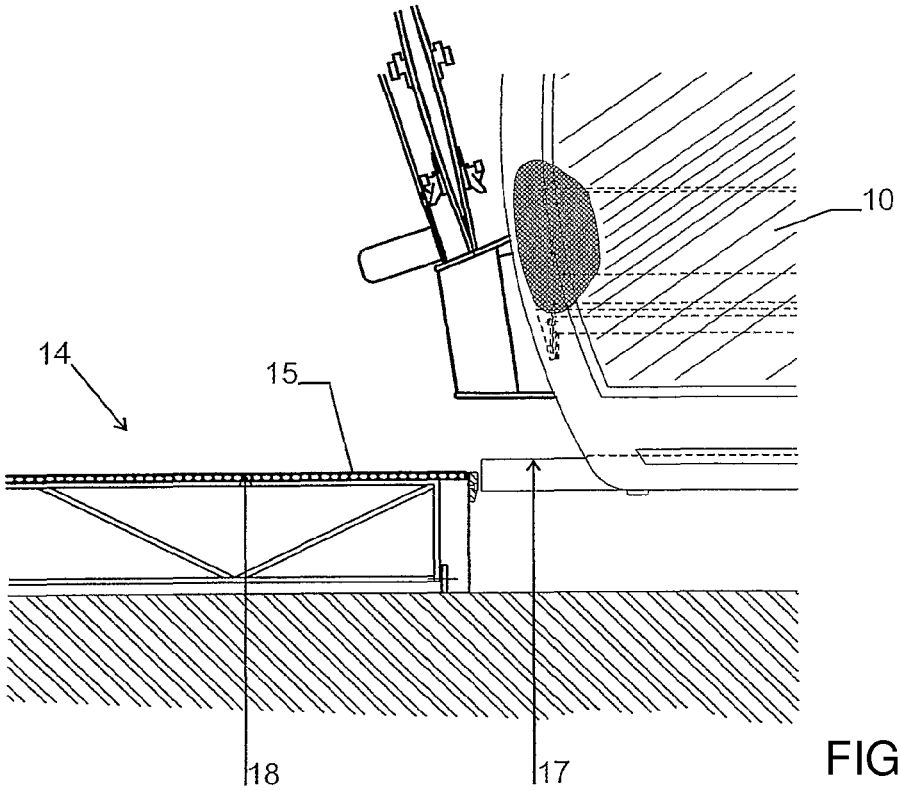
FIG. 2 is a vertical section perpendicular to the running direction of the transporting belt for the situation in which the passengers can board the passenger gondola without a step.

In a preferred variant illustrated in FIG. 2, the boarding height 17 of the passenger gondolas in the passenger region 12 is substantially at the height of the upper side 18 of the conveying means 14 or the conveying belts 15. This facilitates boarding. However, in this case, it is necessary to ensure that the relative vertical position of the passenger gondolas 10 and the conveying means 14 or the conveying belts 15 is altered toward the exit-side region 16 of the station in such a way that the conveying means comes to lie sufficiently low below the passenger gondolas.

A plurality of regions in which the conveying means has differing height are therefore preferably provided. In a first region, namely in the passenger region 12, the conveying means runs at a first height and in a second region, namely the exit-side region 16 which is positioned below the conveying route of the passenger gondolas 10, it runs at a second, lower height. In the second region, the conveying means is lowered sufficiently far in relation to the passenger gondolas that the floor 19 of the passenger gondolas 10 can be guided without difficulty via the conveying means 14.

Alternatively or additionally to a lowering of the conveying means 14, the passenger gondolas 10 can be guided in such a way that they are raised in the vertical direction before traversing the conveying means 14.

It is also conceivable to provide one or more regions in which the conveying means runs during normal operation at the height illustrated in FIG. 2, but can be lowered as desired in order in this way for example to allow it to remove individual passenger gondolas 10 from the normal path in the region of the station, for example for garaging, or to return them to the normal path.

Figure 3:
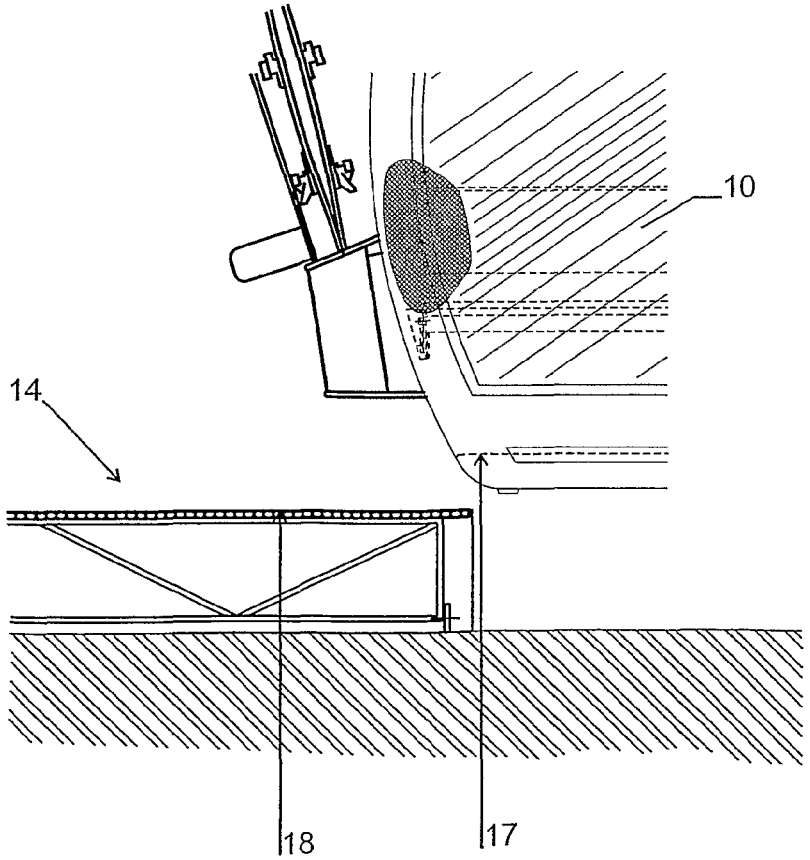
FIG. 3 is a vertical section perpendicular to the running direction of the transporting belt when boarding the passenger gondola from a step.

FIG. 3 illustrates an embodiment of the installation in which it is not possible to board the passenger gondolas 10 at the same level. On the contrary, the boarding height is above the upper side of the conveying means 14 by for example 20 cm and the passengers have to surmount a step when boarding. In addition, the floor 19 of the passenger gondolas 10 is also located over the height of the conveying means 14, so that it is possible for the routes of the conveying means and the passenger gondolas to cross without lowering the conveying means.

In order to allow the individual conveying belts 15*a*, 15*b*, 15*c*, . . . to be guided around the arc illustrated in FIG. 1, they must be configured flexibly and laterally guided on their paths.

Figure 4:
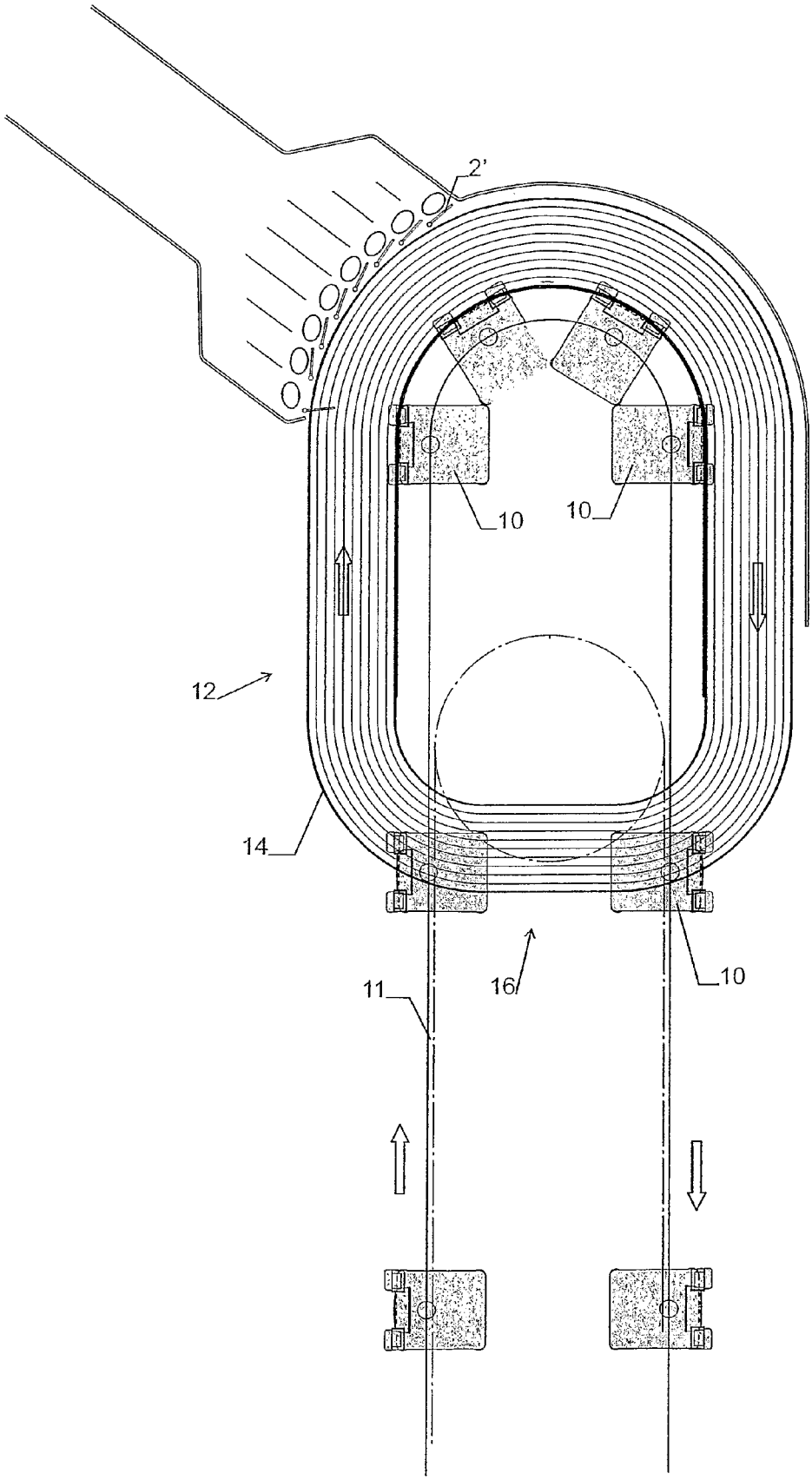
FIG. 4 shows the embodiment according to FIG. 1 with access barriers.

In order to achieve the intended capacity of the installation and to reduce the risk of accidents, the installation can be equipped with individual barriers 20 such as are illustrated in FIG. 4. The individual barriers 20 each allow individual persons to access the passenger region 12 at different times, care being taken to ensure that the routes of the individual passengers are also roughly the same. This prevents swarming in front of the gondola entrances and makes boarding safer.

Figure 5:
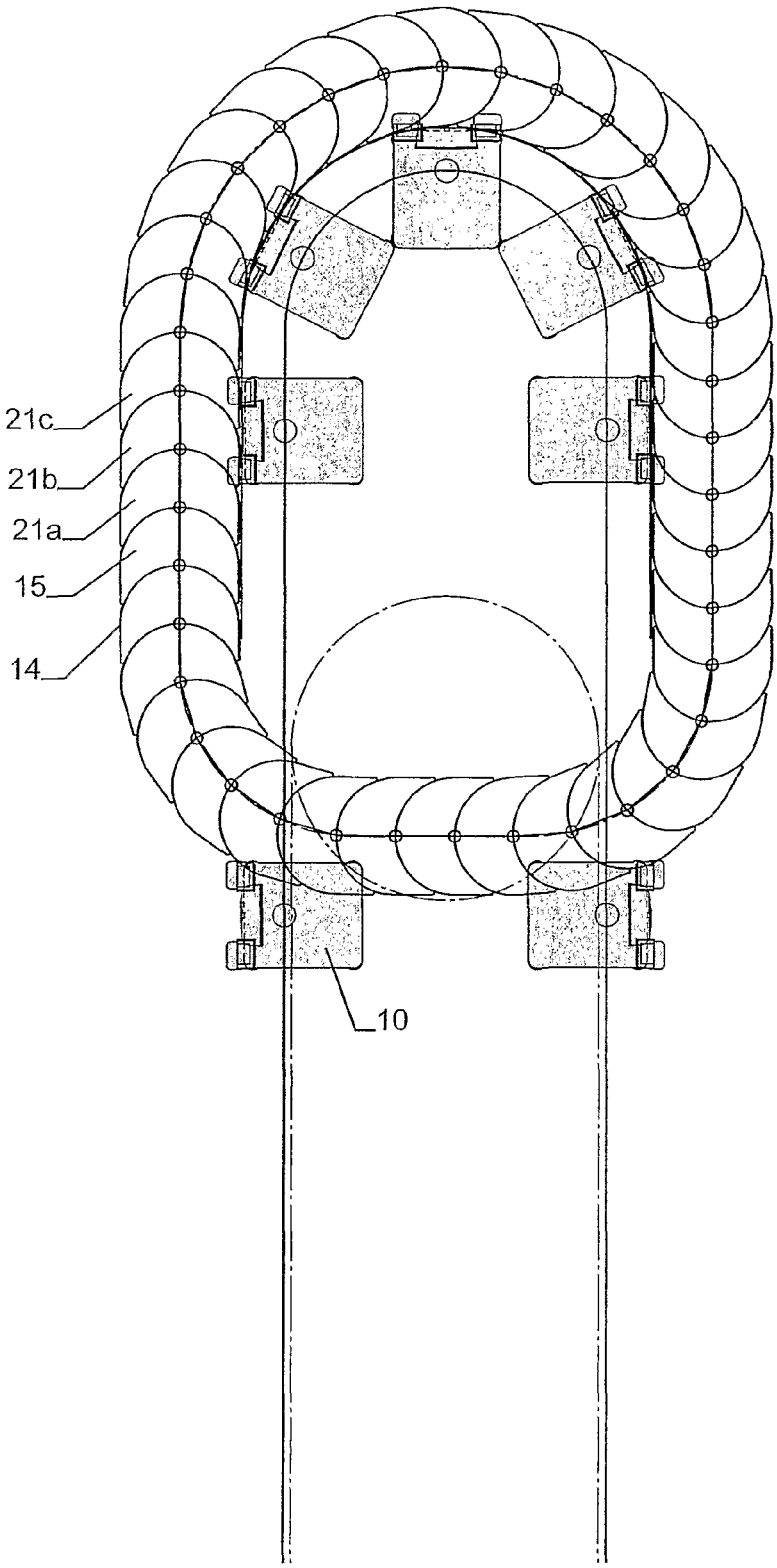
FIG. 5 is a plan view onto a second embodiment of the invention.

FIG. 5 shows a further embodiment of the invention in which the conveying means 14 is formed by an individual conveying belt 15 having a plurality of conveying plates 21*a*, 21*b*, 21*c*, . . . . The conveying plates abut one another laterally and are mounted so as to be able to rotate relative to one another about respectively vertical axes, such as is known from conventional plate belts. A plate belt of this type can travel through both arc-shaped and straight sections. It is also possible to use a plurality of plate belts in parallel, as illustrated in FIG. 1.

Figure 6:
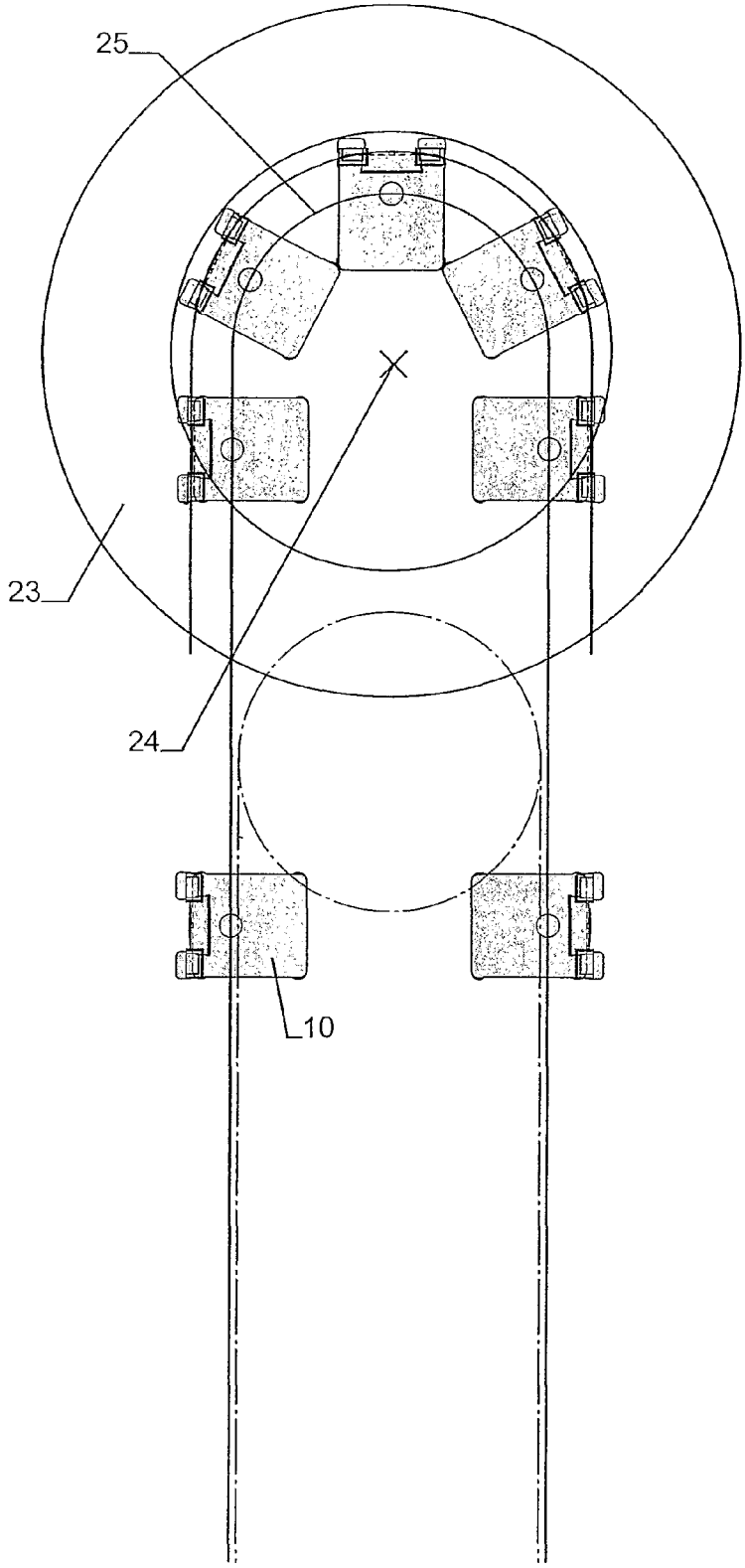
FIG. 6 is a plan view onto a third embodiment of the invention.

FIG. 6 shows a third embodiment of the invention in which the conveying means 14 is formed by a platform 23 and has the shape of a ring or a disc. In itself, the platform 23 is substantially rigid and rotates about a vertical central axis 24. The central axis 24 also forms the center point of the circular looping arc 25 on which the passenger gondolas 10 run. In this embodiment, the passenger firstly steps on the platform 23 from which he boards the gondola 10.

It is also possible for a plurality of platforms 23 to be provided as concentric rings, the innermost ring running fastest and the rings positioned further outward running increasingly slowly. In this way too, the conveying means 14 can be divided in accordance with the solution according to FIG. 1 into a plurality of conveying regions having different speeds.

As mentioned hereinbefore, the conveying means 14 preferably at least adjoining the passenger gondolas 10 should run roughly at the same speed as these. However, embodiments are also conceivable in which the conveying means 14 runs somewhat more slowly than the passenger gondolas 10, allowing at least some of the advantages of the invention still to be achieved, while mounting the conveying means is simplified.

The conveying power of a cable railway comprising gondolas is in principle defined by the number of gondolas which can be transported per hour and is of course also dependent on how many persons have a place in these gondolas.

In the stations, there are two criteria: on the one hand, the geometry of the gondola, which defines the minimum distance between the gondolas during the arcuate bypassing, and furthermore the speed of the gondolas. The gondola geometry is hardly variable and the speed may in conventional installations be little more than 0.3 m/s for the reasons given, as otherwise the aforementioned problems occur. The present invention allows the distance between gondolas or the time by which the gondolas follow one another to be shortened on the section and thus also in the station. This allows a substantial rise in power of the installation to be achieved.

In order to fulfill the criteria in the stations again, the speed of the gondolas has to be increased.

That means that a rise in power of the installation is achieved if the conveying belt on the gondola is moved at 0.3 m/s or more and a certain differential speed is also allowed.

As illustrated in the figures, the conveying means 14 adjoining the passenger gondolas 10 moves parallel thereto and is also able to follow the arc-shaped course of the looping arc.

It is however also conceivable to arrange the conveying means at a region where the passenger gondolas 10 move on a straight line. This simplifies the design of the conveying means, as the conveying means does not have to be guided on a curve. This embodiment is relevant above all in intermediate stations, as the looping arc is dispensed with in such cases.

In another advantageous embodiment, use may be made of what is known as an accelerating walkway which allows the passengers to be increasingly accelerated in the running direction of the belt, so that they can mount a relatively slow belt which then accelerates them to higher speeds. A design of this type is described in the journal "Das ThyssenKrupp Magazin" 2/2003 on pages 108-111.

The conveying means moves roughly at a speed at which known walkways also move, such as may conventionally be found at shopping centers or airports.

In order to increase slip resistance, the surface of the conveying means 14 can be made of slip-proof material. The term "'slip-proof' material" refers in this case to a material or a surface composition leading to much higher static friction between footwear and the substrate than a bare metal or plastics material face.

A handrail can be attached to the edge of the conveying means 14 in certain regions.

The present invention largely prevents hazardous situations when passengers board and alight, as a result of which video monitoring may be sufficient for inspection purposes.

Although the present application describes preferred embodiments of the invention, it should clearly be pointed out that the invention is not limited thereto and can be carried out in other ways too within the scope of the following claims.

The invention claimed is:

1. A cable railway, comprising:

a plurality of passenger gondolas;

a passenger region enabling passengers to embark and/or disembark from said gondolas as said gondolas traverse said passenger region along a given path and in a given direction of movement;

said passenger region having a floor adjoining said given path of said passenger gondolas for supporting the passengers as they embark and/or disembark from said gondolas, wherein at least a portion of said floor is formed with a conveying device for transporting passengers located on said conveying device along said passenger gondolas and in the given direction of movement of said passenger gondolas;

said conveying device having a plurality of conveyor belts running next to one another at mutually different speeds.

2. The cable railway according to claim 1, wherein said conveying device comprises at least one conveyor belt.

3. The cable railway according to claim 2, wherein said conveyor belt includes a plurality of conveying plates.

4. The cable railway according to claim 3, wherein said conveying plates are rotatably supported relative to one another about substantially vertical axes.

5. The cable railway according to claim 2, wherein said conveyor belt has at least one continuous belt for supporting the passengers.

6. The cable railway according to claim 1, wherein said conveying device adjoining said passenger gondolas moves parallel to said passenger gondolas.

7. The cable railway according to claim 6, wherein said conveying device and said passenger gondolas follow an arc-shaped course.

8. The cable railway according to claim 1, wherein said conveying device adjoining said passenger gondolas moves at an equal speed.

9. The cable railway according to claim 8, wherein said conveying device adjoining said passenger gondolas moves at a slower speed than said passenger gondolas.

10. The cable railway according to claim 1, wherein said conveying device comprises a plurality of conveying regions running at mutually different speeds.

11. The cable railway according to claim 10, wherein said plurality of conveying regions includes a relatively fastest conveying region nearest to and adjoining an entry to said passenger gondolas.

12. The cable railway according to claim 1, wherein said conveying device is disposed to run, at least in a part of said passenger region, at an entry level of said passenger gondolas.

13. The cable railway according to claim 1, wherein a surface of said conveying device is made of slip-proof material.

14. The cable railway according to claim 1, wherein said conveying device is configured to increasingly accelerate the passengers in the given direction of movement.

15. A cable railway, comprising:

a plurality of passenger gondolas;

a passenger region enabling passengers to embark and/or disembark from said gondolas as said gondolas traverse said passenger region along a given path and in a given direction of movement;

said passenger region having a floor adjoining said given path of said passenger gondolas, wherein at least a portion of said floor is formed with a conveying device for transporting passengers located on said conveying device along said passenger gondolas and in the given direction of movement of said passenger gondolas; and wherein a first region of said conveying device runs at a first height and a second region of said conveying device runs at a second height, wherein the first height is higher than the second height or the first height can be set so as to be higher than the second height.

16. The cable railway according to claim 15, wherein said second region is positioned below a conveying route of said passenger gondolas.

* * * * *